US012203724B2

(12) United States Patent
Risley

(10) Patent No.: US 12,203,724 B2
(45) Date of Patent: Jan. 21, 2025

(54) PREVENTING MOVEMENT OF GAS IMPINGEMENT SYSTEM COUPLED TO FIREARM

(71) Applicant: Unleashed Defense LLC, Cave Creek, AZ (US)

(72) Inventor: Matt Risley, Phoenix, AZ (US)

( * ) Notice: Subject to any disclaimer, the term of this patent is extended or adjusted under 35 U.S.C. 154(b) by 0 days.

(21) Appl. No.: 17/825,163

(22) Filed: May 26, 2022

(65) Prior Publication Data

US 2023/0026346 A1 Jan. 26, 2023

Related U.S. Application Data

(60) Provisional application No. 63/193,693, filed on May 27, 2021.

(51) Int. Cl.
*F41C 23/16* (2006.01)
*F41G 11/00* (2006.01)

(52) U.S. Cl.
CPC ..... *F41C 23/16* (2013.01); *F41G 11/003* (2013.01)

(58) Field of Classification Search
CPC ..... F41C 23/16; F41G 11/003
See application file for complete search history.

(56) References Cited

U.S. PATENT DOCUMENTS

| | | | | |
|---|---|---|---|---|
| 8,739,448 | B2 * | 6/2014 | Kimmel | F41C 23/16 42/72 |
| 10,436,549 | B1 * | 10/2019 | Taylor | F41C 23/16 |
| 10,775,129 | B1 * | 9/2020 | Kincel | F41C 23/16 |
| 10,809,038 | B2 * | 10/2020 | Geissele | F41C 23/16 |
| 10,935,343 | B2 * | 3/2021 | Chin | F41A 11/00 |
| 11,193,730 | B2 * | 12/2021 | Becklin | F41C 23/16 |
| 11,248,874 | B2 * | 2/2022 | Kincel | F41A 21/48 |
| 11,326,853 | B2 * | 5/2022 | Zinsner | F41A 21/48 |
| 11,371,802 | B2 * | 6/2022 | Liao | F41A 21/48 |
| 11,408,696 | B2 * | 8/2022 | Gerlings | F41A 5/28 |
| 2011/0126443 | A1 * | 6/2011 | Sirois | F41C 23/16 42/90 |
| 2018/0202757 | A1 * | 7/2018 | Samson | F41A 21/48 |
| 2022/0018629 | A1 * | 1/2022 | Senff | F41A 21/482 |
| 2022/0128331 | A1 * | 4/2022 | Kincel | F41A 21/48 |
| 2022/0252374 | A1 * | 8/2022 | Louthan | F41C 23/16 |
| 2022/0260335 | A1 * | 8/2022 | Williams | F41G 11/003 |
| 2022/0404119 | A1 * | 12/2022 | Zinsner | F41A 21/487 |

* cited by examiner

*Primary Examiner* — Michelle Clement
(74) *Attorney, Agent, or Firm* — Schmeiser, Olsen & Watts, LLP

(57) ABSTRACT

A coupling mechanism comprises a first engaging portion constructed and arranged for direct coupling to a handguard of a firearm; a second engaging portion constructed and arranged for direct coupling to a body of the firearm; and at least one reinforcement element extending between the first engaging portion and the second engaging portion for applying a force that maintains an interface formed between the handguard and the body of the firearm.

9 Claims, 12 Drawing Sheets

PREVENTING MOVEMENT OF GAS IMPINGEMENT SYSTEM COUPLED TO FIREARM

RELATED APPLICATIONS

This application claims priority to U.S. Provisional Application Ser. No. 63/193,693 filed on May 27, 2021 entitled "PREVENTING MOVEMENT OF GAS IMPINGEMENT SYSTEM COUPLED TO FIREARM," the entirety of which is incorporated by reference herein.

FIELD OF THE INVENTION

The inventive concepts relate generally to gas-operated firearms. More specifically, the inventive concepts relate to a system that prevents displacement or rotation of a gas impingement system of a gas-operated rifle.

BACKGROUND

Modern gas-operated firearms, for example, the assault rifle 10 shown in FIG. 1, include a gas impingement system 10 that includes well-known components such as a gas block 22, gas port 24, and gas tube 26 extending between the barrel 12 and a bolt carrier group 14. During operation, hot gas is routed through the gas port 24 into the gas tube 26. In order to ensure that the gun fires smoothly, the gas impingement system 10 diverts a portion of the hot gas which propels a projectile, e.g., a bullet, from the gas block 22 back to the bolt carrier group 14 to automatically reload a new round of ammunition.

A handguard 28 may be positioned about at least a portion of the gas impingement system 10 and constructed to accommodate for a recoil of the rifle during operation. When the rifle 10 is fired, the primer of the bullet cartridge ignites the powder inside the casing of the bullet to generate an explosive reaction, which produces gas that force the bullet down the barrel 12. As the gas passes the gas port 24 in the barrel 12, at least a portion of the gas is diverted into the gas block 22, and into a gas tube 26 which carries the gas into the bolt carrier group 14. Once the gas arrives at a key of the bolt carrier 14, it outputs the gas into a chamber 16 generating a force that moves the bolt carrier group 14 in a rearward direction, i.e., opposite the direction of movement of the bullet. The spent shell is ejected from the rifle as the bolt carrier group 14 returns to its starting position.

During operation, the rifle 10 may be dropped or experience trauma due to an action that will loosen the gas impingement system. With an undesirable rotation or other movement of the handguard 28, the gas impingement system can be damaged or be knocked off the rifle 10.

SUMMARY

In one aspect, a coupling system for a firearm comprises a top mounting system constructed and arranged for a direct coupling an upper assembly to a handguard of a firearm; bottom mounting system constructed and arranged for a direct coupling the handguard to the upper assembly; and a plurality of fastening devices that couple the handguard to an upper assembly of the firearm and for applying a force that maintains an interface formed between the handguard and the upper assembly.

In another aspect, a coupling mechanism for a firearm comprises a first engaging portion constructed and arranged for direct coupling to a handguard of a firearm; a second engaging portion constructed and arranged for direct coupling to a body of the firearm; and at least one reinforcement element extending between the first engaging portion and the second engaging portion for applying a force that maintains an interface formed between the handguard and the body of the firearm.

DETAILED DESCRIPTION OF THE EMBODIMENTS

In the following description, specific details are set forth although it should be appreciated by one of ordinary skill that the systems and methods can be practiced without at least some of the details. In some instances, known features or processes are not described in detail so as not to obscure the present invention.

In brief overview, provided in some embodiments of the present inventive concept is a system and/or apparatus that prevents displacement, rotation, or other undesired movement of a firearm's handguard, which in turn can damage components of a gas impingement system about which the handguard is positioned, for example, when the rifle is dropped or trauma or force is applied to the handguard. The firearm can be an automatic or semi-automatic rifle, but not limited thereto.

Figure 1:
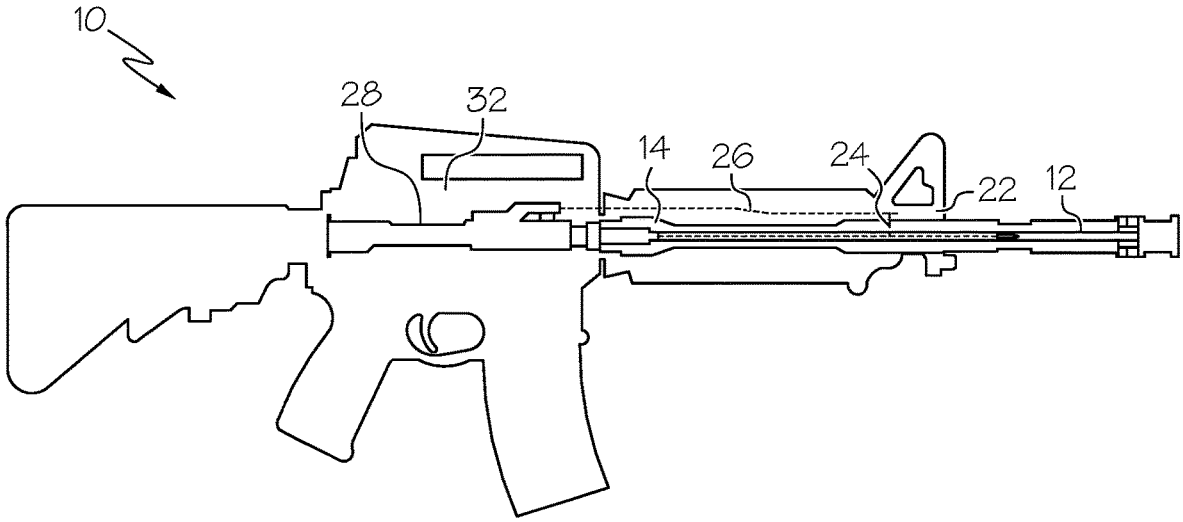
FIG. 1 is a cross-sectional view of a rifle having a conventional gas impingement system.
Figure 2:
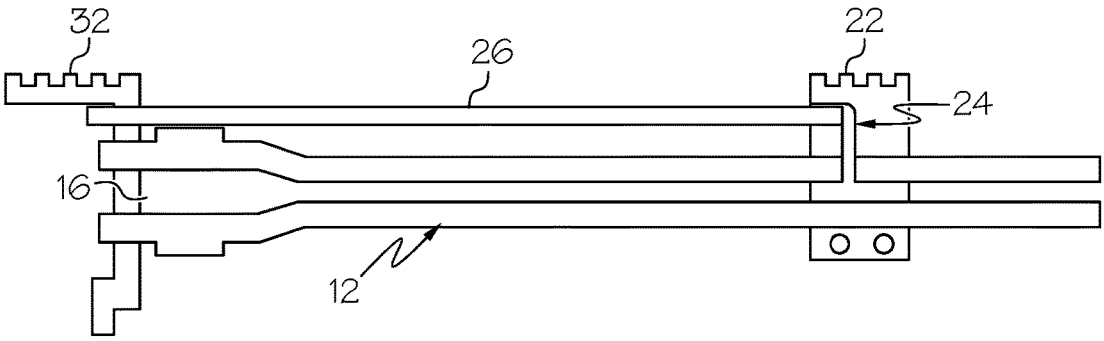
FIG. 2 is a cross-sectional view of the conventional gas impingement system of FIG. 1.
Figure 3A:
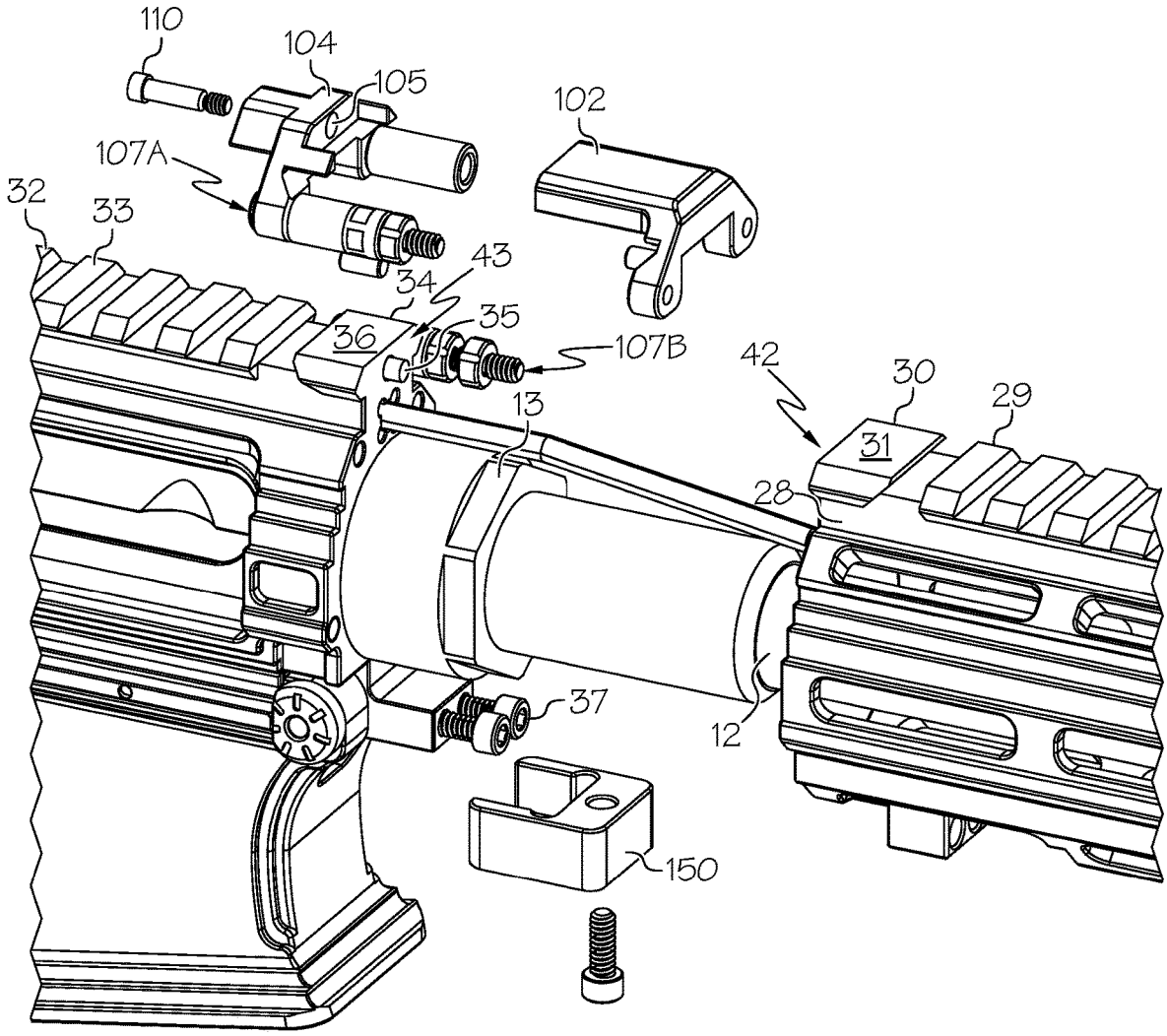
FIG. 3A is an exploded perspective view of a firearm coupling mechanism, in accordance with some embodiments.
Figure 3B:
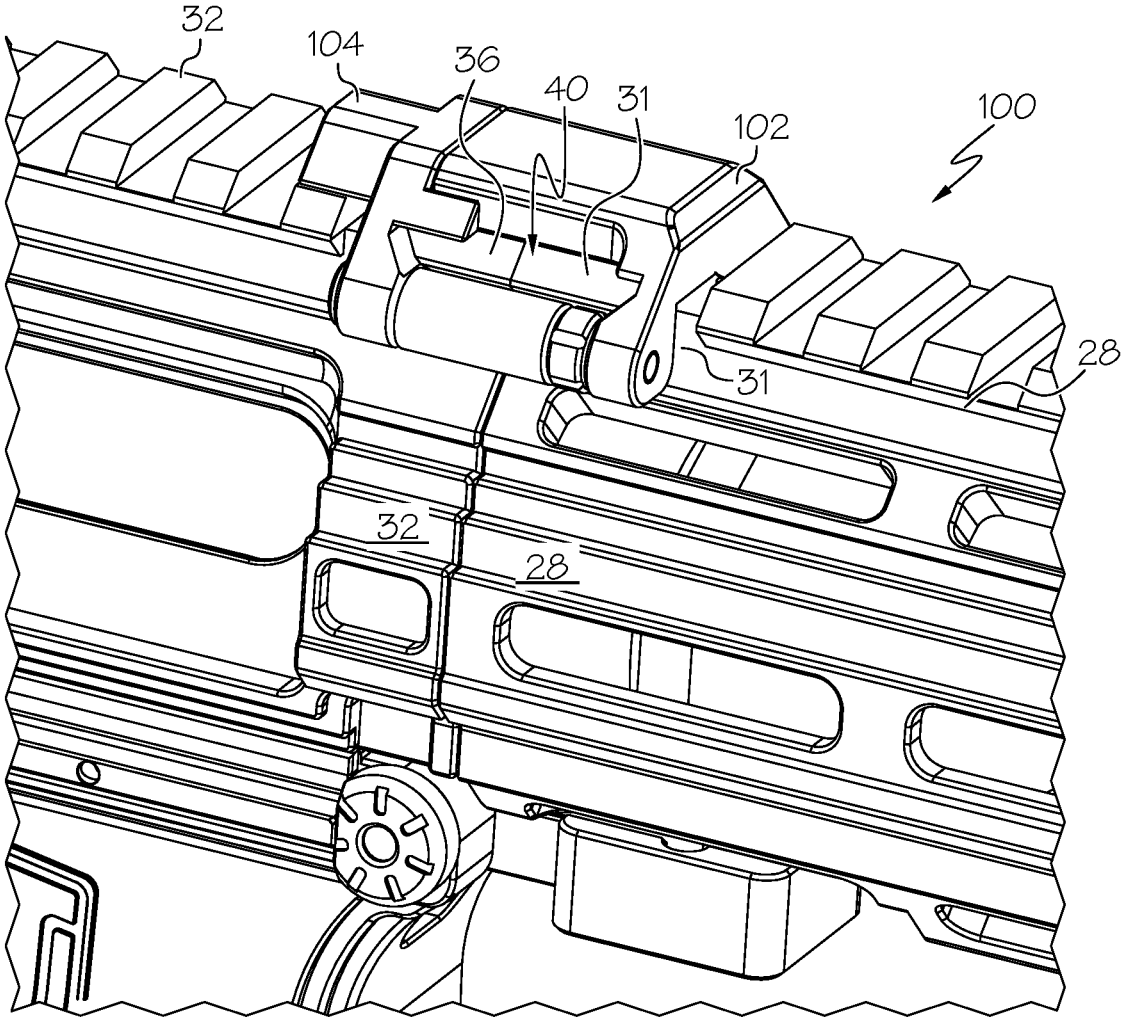
FIG. 3B is a perspective view of the firearm coupling mechanism in an assembled state.

FIG. 3A is an exploded closeup perspective view of a firearm coupling mechanism 100, in accordance with some embodiments. FIG. 3B is a closeup perspective view of the firearm coupling mechanism 100 in an assembled state. The firearm coupling mechanism 100 locks the barrel assembly 12 and the body of the gun together on the top and bottom of the rifle. In some embodiments, the body includes the upper assembly 32 as well as other well-known firearm components, but absent the handguard which is an accessory for coupling to the body. In other embodiments, the body includes a combination of upper assembly 32 and hand guard 28. The handguard engaging portion 102 and body engaging portion 104 are coupled together to join the upper assembly 32 and handguard 28. Rotational forces may be applied to the upper assembly 32 and handguard 28, which are counteracted by the handguard engaging portion 102 and body engaging portion 104 coupled together.

The handguard 28 can be positioned about the gas block 22, gas port 24, gas tube 26, and/or other components of the gas impingement system 100 about which the handguard 28 is positioned or proximal to, such as the gas key (not shown) attached to the gas tube 26 for forcing the gasses back from the barrel 12 to enter the receiver 32 for cycling the bolt carrier group 14. The firearm coupling mechanism 100 prevents a rotation or other unintentional motion of the handguard 28 that may damage these components.

The barrel assembly 12 is typically mounted to the receiver assembly 32 by a barrel nut 13 or related threaded element, but not limited thereto. Here, the barrel nut 13 or the like establishes the longitudinal axis along which the barrel 12 and gas tube 26 extend. The rigid structure of the barrel 12 extending from the rifle body in this manner can create forces such as torque that increase the risk of rotation of the handguard 28 about the barrel's longitudinal axis. As described herein, the firearm coupling mechanism 100 prevents the handguard 28 from rotating relative to the barrel 28. A top portion of the firearm coupling mechanism 100 includes a handguard engaging portion 102 (also referred to as a first clamp piece) and body engaging portion 104 (also referred to as a second clamp piece) that collectively form a clamping mechanism that couples the handguard 28 and upper assembly 32 together, and locks the barrel 12 in place relative to the body so that the handguard 28 doesn't exhibit an undesirable movement independently of the body so as to damage the gas impingement system 10. In some embodiments, each of the handguard 28 and upper assembly 32 has a castellated surface, for example, so that a scope, laser, and/or other accessories can be coupled thereto. The handguard engaging portion 102 and the body engaging portion 104 when coupled about the castellated surfaces of the handguard 28 and upper assembly 32, respectively can cause the handguard 28 and upper assembly 32 to be coupled notwithstanding a direct abutting or small gap therebetween.

In some embodiments, for example, shown in FIG. 3A, the handguard 28 has a rail 29 or other castellated surface, i.e., grooves, cut, or the like on its upper surface, so that a scope or the accessories can be coupled thereto. The castellated rail 29 of the handguard 28 can be similar to rail 33 of the upper assembly 32. The rails 29, 33 can extend along a same axis, and coupled together. The interface formed by the sidewall 42 of an end 30 of the handguard rail 29 and the sidewall 43 of an end 34 of the upper assembly 32 into which the firearm coupling mechanism 100 can be positioned for coupling between the handguard 28 and the upper assembly 32. The gap can be closed by directly or nearly abutting a sidewall 42 of the handguard 28 extending downwardly from the rail interface 29 and a sidewall 43 extending downwardly from the rail 33 at a distal end of the upper assembly 32 of the rifle body. The handguard engaging portion 102 and body engaging portion 104 that collectively form a clamping mechanism of the firearm coupling mechanism 100 are positioned over the interface 40 formed at the sidewalls of the 42, 43 of the handguard rail end 30 and upper assembly end 34, respectively.

The handguard rail end 30 has first and second tapered sidewalls 31 that are perpendicular to the sidewall 42. The tapered sidewalls 31 decrease a width of the end 30 of the handguard rail 29 along a vertical axis. Similarly, the upper assembly end 34 has first and second tapered sidewalls 36 that are perpendicular to the sidewall 43. The handguard engaging portion 102 is specifically constructed and arranged for positioning about the tapered sidewalls 31 of the handguard 28 and in doing so is fixedly and removably attached to the handguard 28. The handguard engaging portion 102 has a first side engaging portion 121 and a second side engaging portion 122 and a top engaging portion 126 that at least partially surround the handguard rail end 30. In particular, the first side engaging portion 121 engages with one tapered sidewall 36 and the second side engaging portion 122 engages with the other tapered sidewall. The top engaging portion 126 engages with the top surface of the end 30 from which the tapered sidewalk extend. In some embodiments, the first and second side engaging portions 121, 122 extend at an angle from the top engaging portion 126, the angle permitting the handguard engaging portion 102 to lock in place against the handguard end 30.

Similarly, the body engaging portion 104 is constructed and arranged for positioning about the tapered sidewalls 36 of the upper assembly 32 and in doing so is fixedly and removably attached to the upper assembly 32. The gas tube 26 and/or other nearby components may need to be removed, replaced, maintained, and/or serviced. In doing so, the handguard 28 must be removed in order for the gas impingement system to be accessed for service, removal, etc. with simplicity. The construction of the firearm coupling mechanism 100 can aid in the accessibility to the gas impingement system after removal of the handguard 28.

In some embodiments, the handguard engaging portion 102 has a lip, groove, indent, or other coupling feature for engaging with a tapered sidewall 44 of the handguard rail end 30 opposite the sidewall 42. In some embodiments, the body engaging portion 104 has a lip, groove, indent, or other coupling feature for engaging with a tapered sidewall 45 of the handguard rail end 30 opposite the sidewall 43.

In some embodiments, the firearm coupling mechanism 100 has a pin 110 (also referred to as a shoulder bolt) or related elongated object that extends through an aperture 105 in the body engaging portion 104 and into an opening the extends through at least a portion of the handguard engaging portion 102. In some embodiments, the body engaging portion 104 permits the shoulder bolt 110 to slide into and out of a bore extending through the body of the coupling component 104, wherein the head of the bolt (not shown) travels in the bore of the body engaging portion 104. In some embodiments, the shoulder bolt 110 includes a detent and spring for permitting the shoulder bolt to be separated from the handguard engaging portion 102 when a user applies a force to the shoulder bolt 110. The shoulder bolt can therefore limit travel of the clamp pieces 102, 104 relative to each other and also operating to couple the clamp pieces 102, 104 together.

In some embodiments, the firearm coupling mechanism 100 includes first and second connector elements 107A, 107B, each having a head 113, shank 114, thread 115, and nut 109. In some embodiments, the shank 114 is wider than the thread 115. The thread 115 of the first connector element 107A is configured for engaging with a threaded opening 123 of the first side engaging portion 121. The thread 115 of the second connector element 107B is configured for engaging with a threaded opening 123 of the first side engaging portion 122. The nut 109 can be adjusted to determine the amount of force enacted by the connector elements between the engaging portions 102, 104. For example, a force can be applied to bring the engaging portions 102, 104 together to form a sufficient interface 40 to protect the handguard 28 from rotation or other movement that could damage the gas impingement system 10 and/or band 12 under the handguard 28. In some embodiments, the end 34 of the upper assembly 32 includes a pin 35 or other protruding element that mates with a hole (not shown) in the end 30 of the handguard 28 which offers further stability when the coupling mechanism 100 applies a force to bring the ends 30, 34 together, e.g., similar to a squeezing manner.

Figure 4:
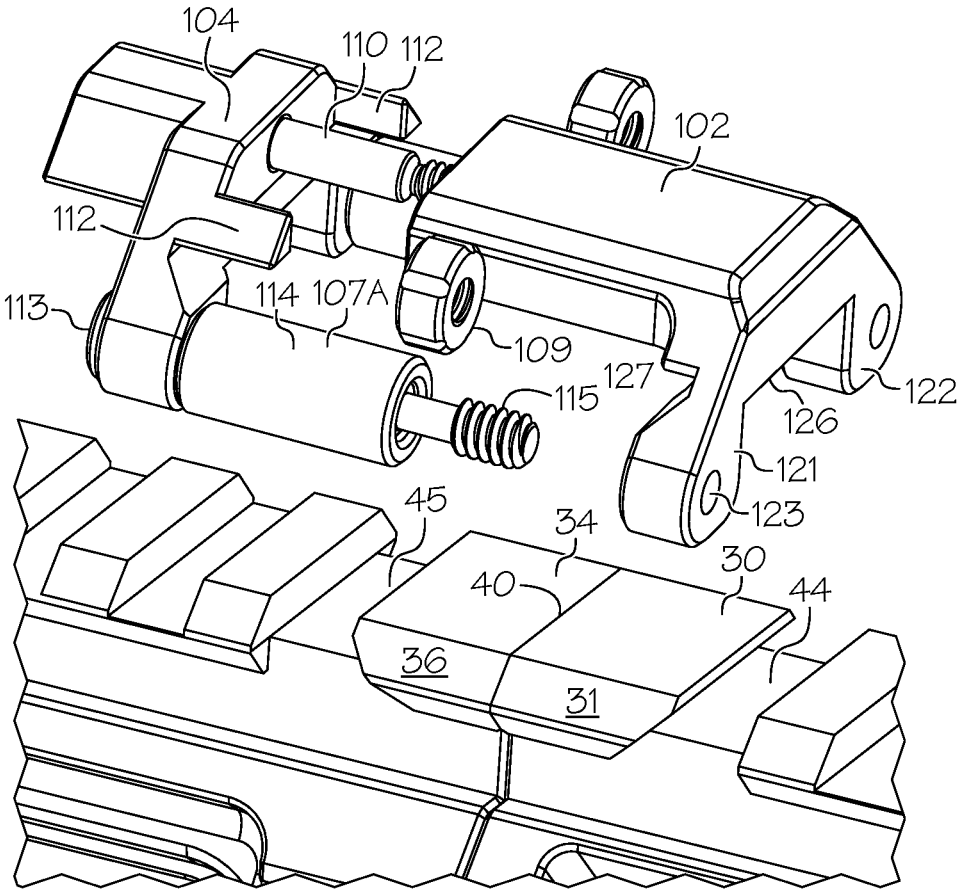
FIG. 4 is a close-up perspective view of a top portion of the firearm coupling mechanism of FIGS. 3A and 3B.
Figure 4A:
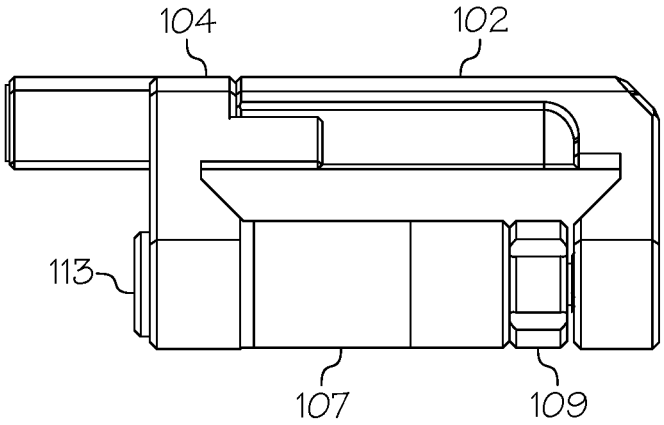
FIGS. 4A and 4B are side views of the firearm coupling mechanism of FIGS. 3A-4 in a closed/locked and open/unlocked position, respectively.
Figure 4B:
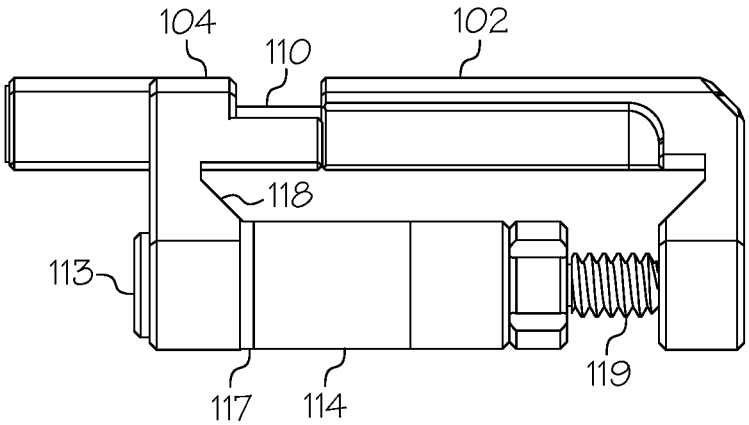

As shown in FIGS. 4A and 4B, a spacer 117 may be positioned between the shank 114 and the head 113 of the connector element 107 coupled to the bottom region of the body engaging portion 104 to prevent an excessive force, e.g., overtightening, of the clamp bodies 102, 104. Assembly may include inserting the socket head bolt 115 extending from the shank 114 in an open position (see FIG. 4B) into a threaded opening 123 of first side engaging portion of the handguard engaging portion 102. The nut 109 may be positioned over a region of the bolt 115 that does not have threads, which permits the nut and spacer to be retained to the handguard engaging portion 102.

In some embodiments, the handguard engaging portion 102 may have a dovetail cut 118 as shown in FIGS. 4A and 4B. The body engaging portion 104 may also have a dovetail cut 119. A dovetail cut into the picatinny rail of the firearm coupling mechanism 100 in this manner is paramount in preventing rotation. Here, proper tooling and fixtures are required for customers to cut their existing rail in order to accommodate the coupling mechanism 100. This allows the clamp components 102, 104 to lock together via friction or the like. The spacer outside diameter limits side-to-side play. This feature also permits the coupling mechanism 100 to be sold as a kit.

Handguards that generally screw into or otherwise coupled or fastened to the body of a firearm can become loosened under various circumstances. This limitation of a screw-in design can be addressed by attaching the upper and lower assembly via a lock system. The coupling mechanism 100 may be part of such a lock system. In preferable embodiments, the lock system is offset from the center bore or center axis as much as possible to utilize leverage and prevent rotation described herein. The kit can be constructed so that the bolts, spacers, and nuts are retained by the body engaging portion 104, for example, shown in FIG. 4. The shoulder bolt 110 couples the components 102, 104 together combining the various elements into a single coupling mechanism, and to prevent the loss or misplacement of the smaller elements such as the nuts 109, etc.

In some embodiments, the body engaging portion 104 includes first and second extenders, or wings 112, that each directly couples with a sidewall of the handguard engaging portion 102. The extenders 112 can complement the pin 110 and first and second connector elements 107 to reinforce the firearm coupling mechanism 100 with respect to preventing rotation of the handguard 28 relative to the barrel 12 and upper assembly 32.

Figure 5:
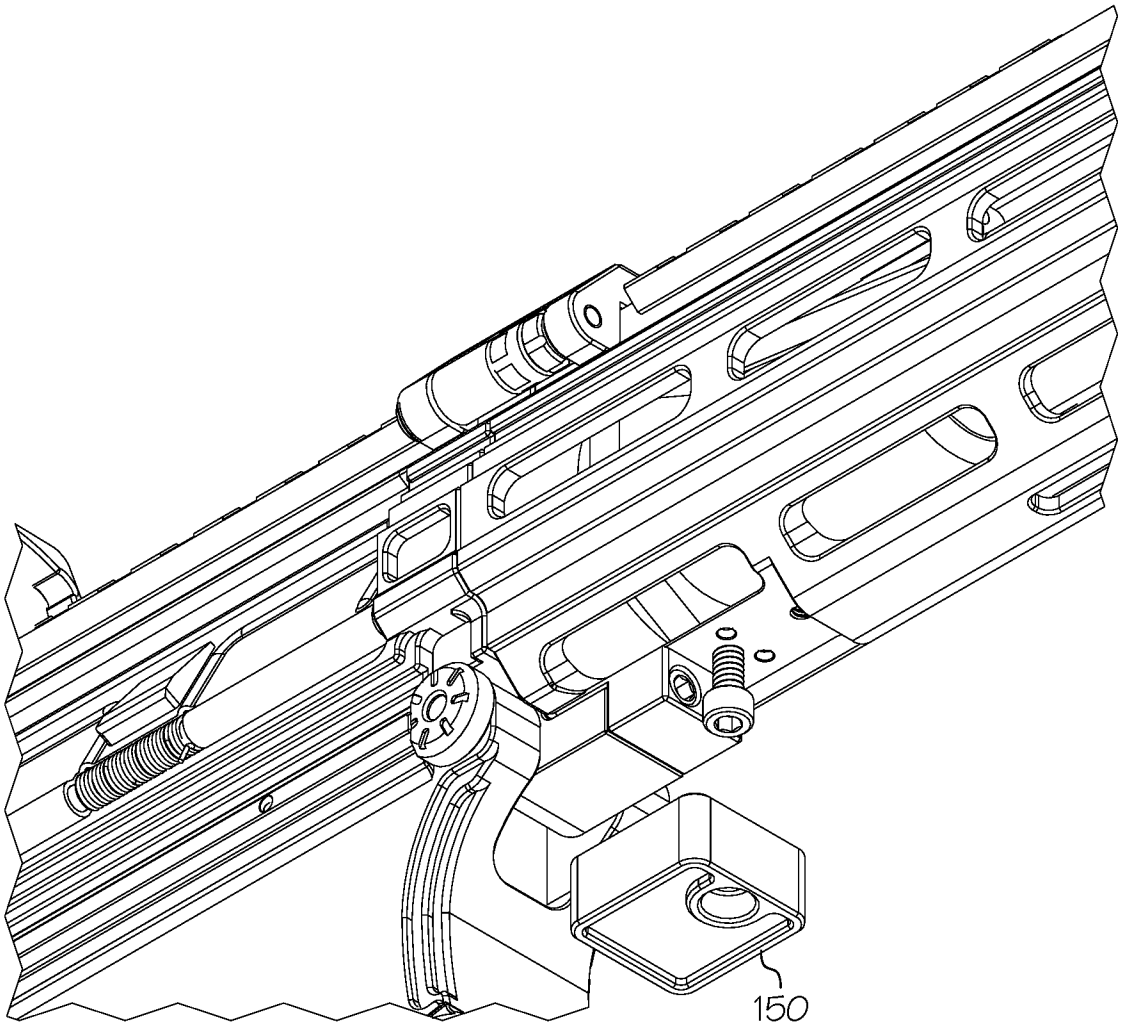
FIG. 5 is a perspective view of a bottom portion of the firearm coupling mechanism of FIGS. 3A and 3B

Referring to FIGS. 3A and 5, a bottom portion 150 of the firearm coupling mechanism 100 can provide added stability to the handguard 28 with respect to protecting the components of the gas impingement system. The bottom portion 150 includes a first portion including a hole for receiving a screw or the like for coupling the bottom portion 150 to a bottom region of the handguard 28. The body of the rifle includes a catch 37 or other protruding feature about which a box-shaped component of the bottom portion 150 can cover when coupled between the body, e.g., a lower receiver, and handguard 28. The bottom portion can therefore also operate to lock the body and barrel together.

Figure 6A:
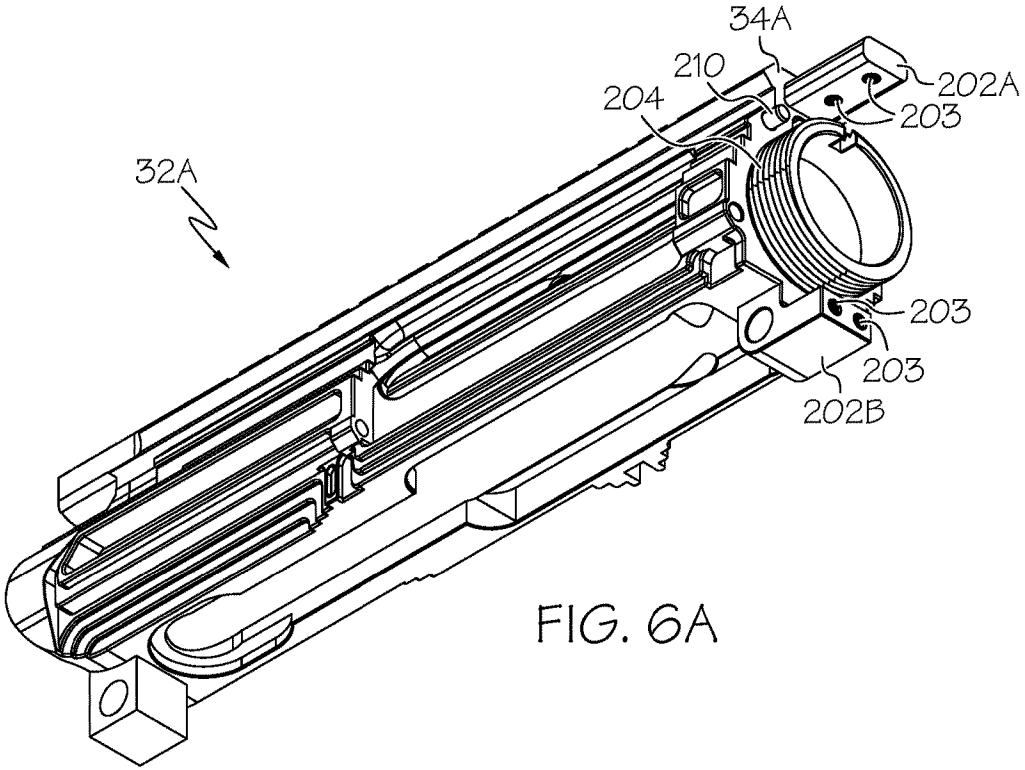
FIG. 6A is a perspective view of an upper assembly of a firearm, in accordance with some embodiments.
Figure 6C:
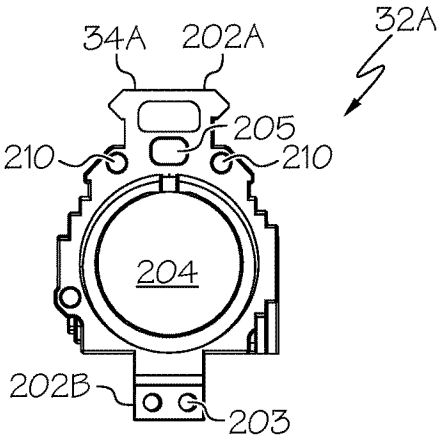
FIG. 6C is a front view of the upper assembly of FIGS. 6A and 6B.
Figure 6B:
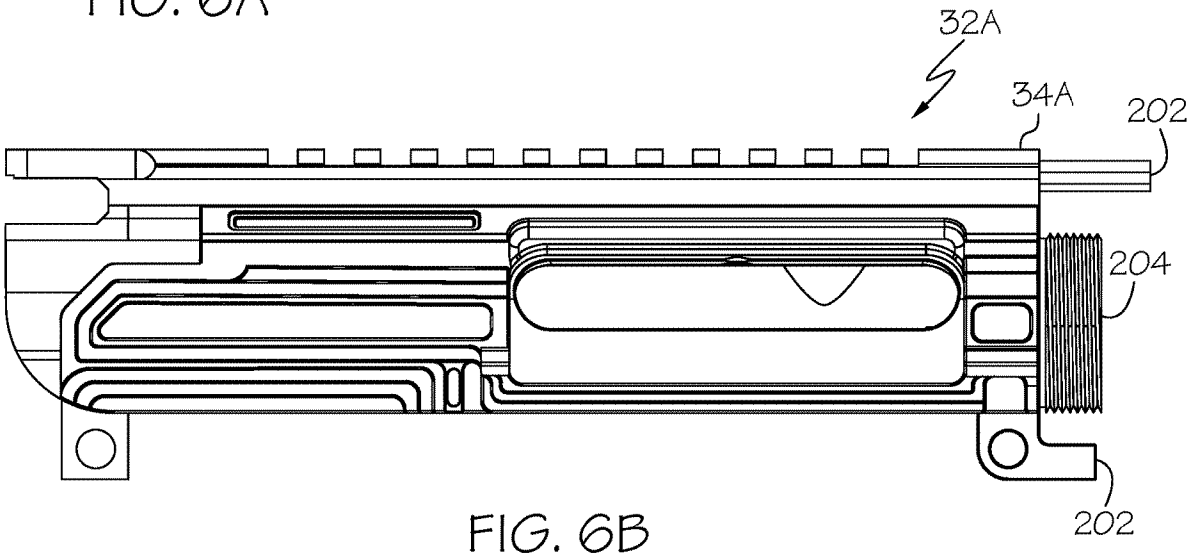
FIG. 6B is a side view of the upper assembly of FIG. 6A.

FIG. 6A is a perspective view of an upper assembly 32A of a firearm, in accordance with some embodiments. FIG. 6B is a side view of the upper assembly 32A of FIG. 6A. FIG. 6C is a front view of the upper assembly 32A of FIGS. 6A and 6B. The firearm can be similar to a firearm 10 of FIGS. 1-5 expect with the differences described herein with the upper assembly 32A described herein.

The upper assembly 32A operates in a well-known manner, so details of the operation of the upper assembly 32A are not repeated due to brevity. In some embodiments, the upper assembly 32A includes a threaded cylindrical end 204 that mates with, i.e., is threaded into a bore of the muzzle brake assembly 20 or other object extending through the interior of the handguard 28A, for example, shown in FIG. 8B.

The upper assembly 32A includes at least one top tab 202A extending from a tapered end 34A of the upper assembly 32A. The top tab 202A can also be referred to as an upper mounting system of a firearm locking system or a coupling mechanism. In some embodiments, the top tab 202A and tapered end 34A are unitary and formed, e.g., machined, molded, or otherwise assembled from a common stock. In other embodiments, the top tab 202A is formed separately and coupled, e.g., bonded, welded, and so on to the tapered end 34A and/or other castellated surface at the distal end of the top region of the upper assembly 32A.

In some embodiments, the upper assembly 32A includes at least one bottom tab 202A extending from a bottom surface of the upper assembly 32A and protruding or extending in a same direction as the top tab 202A, i.e., parallel with the direction of extension of the upper assembly 32A. In some embodiments, the bottom tab 202B is unitary and formed, e.g., machined, molded, or otherwise assembled from a common stock as the body of the upper assembly 32A, similar to the top tab 202A. In other embodiments, the bottom tab 202B is formed separately and coupled, e.g., bonded, welded, and so on to the underside of the upper assembly 32A.

The top tab 202A and bottom tab 202B (generally, 202) add support, mounting locations, and alignment for a handguard 28A (shown in FIGS. 7A-8B). In some embodiments, the tabs 202 each have one or more holes 203, and preferably two holes 203 for receiving mounting bolts 212 (see FIGS. 7A-7C), also referred to as top locking bolts, or other fastening devices such as screws, threaded elongated pins, cotter pins, or other threaded or unthreaded fastening devices, which couple the upper assembly 32A and hand guard 28A together. The holes 203 are arranged so that the mounting bolts can only be mounted if the firearm 10 is aligned in a proper manner, which assures correct alignment of a site, gas rig system, barrel, and muzzle brake, and/or other components of the firearm 10. For example, the top tab 202A extends or protrudes along a direction of extension from an end of the upper assembly 32A. Here, the holes 203 in the top tab 202A are perpendicular to the direction of extension. For example, the holes are vertical when the direction of extension is horizontal. The heads of the top locking bolts 212 or screws are positioned through the holes 203 of the top tab 202A and threaded or otherwise coupled to aligned holes of a handguard rail end 215 at an end of the handguard 28 and are flush with the surface of the handguard 28 when screwed into place, also shown in FIG. 8A. The holes 203 of the bottom tab 202B, on the other hand, may extend along the direction of extension and be perpendicular to the holes 203 of the top tab 202A.

In some embodiments, at least one alignment dowel 210, and preferably two alignment dowels, extend from a region of the upper assembly 32A under the top tab 202A. The alignment dowel 210 is constructed and arranged to triangulate loads and prevent undesirable twisting of one of the upper assembly 32A and handguard 28A relative to the other during operation.

In some embodiments, the upper assembly 32A includes a bore 205 extending through a surface of the upper assembly 32A between the alignment dowels 210 and centered under the top tab 202A and extending through some or all of the length of the upper assembly 32 under the castellated surface. The bore 205 is constructed and arranged for receiving and positioning of a gas line of the gas impingement system, for example, and gas tube 26 extending between the barrel 12 and a bolt carrier group 14 shown in FIG. 2. The bore is formed by a solid framework of the upper assembly body and can be protected from damage due in addition to the abovementioned tabs 202 and alignment dowels 210 operating to prevent twisting, rotation, and so on.

Figure 10:
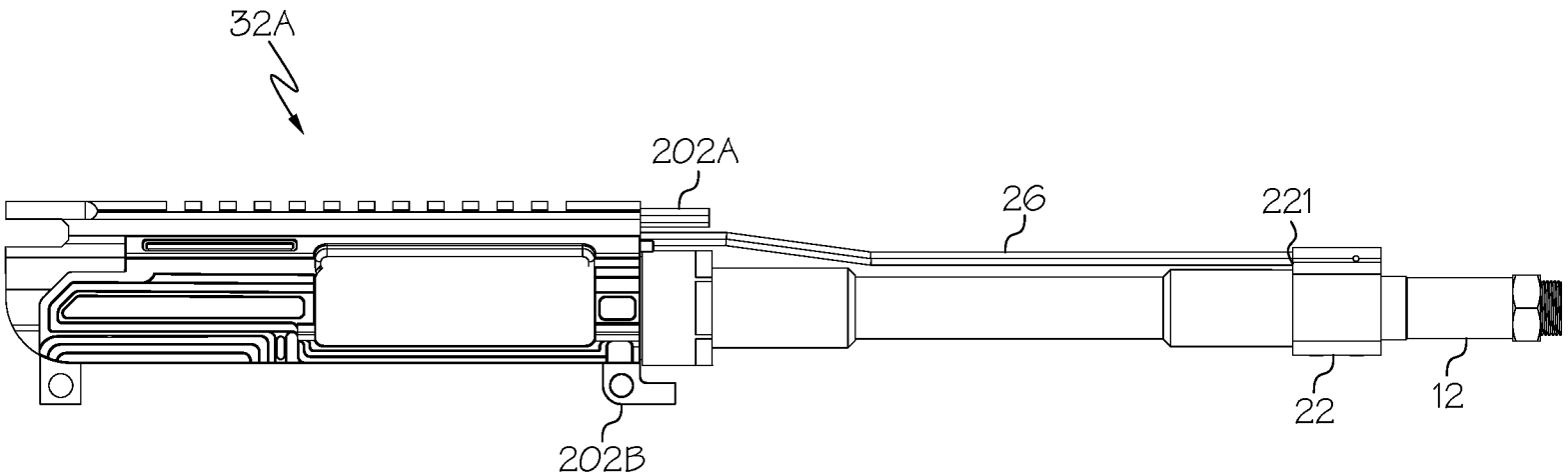
FIG. 10 is a side view of the upper assembly of FIGS. 6A-6C in communication with a gas impingement system, in accordance with some embodiments.

Referring to FIG. 10, the barrel 12 can include at least one hole 221 that aligns with the gas block 22 to dispel a portion of the gasses in the barrel 12. The hole 221 can direct this exerted gas pressure into the upper receiver and aid in reloading a next bullet. The gas line 26 can transfer gas pressure from the gas block 22 to the upper assembly 32A.

Well-known assemblies include handguards that are screwed into the upper assembly. The nut for permitting this threading operation is typically located in the handguard assembly. However, the barrel 12 can be loosened, or unscrewed, during use, which can cause the gas line 26 and/or block 22 to rotate, which in turn can block gas from transfer to the upper assembly. This can affect the firearm's ability to recycle gas, pressure, and so on. Also, a manual sight or other accessories on the handguard may not align properly due to the inadvertent rotation of the handguard. The top and bottom tabs 202, the nut traditionally required for attaching the handguard to the upper assembly is not required because the firearm coupling mechanism 200 can replace the need for the nut. In addition, the firearm coupling mechanism 200 allows the union between the handguard 28A and the upper assembly 32A to not separate, rotate relative to each other, or otherwise experience undesired movement. In addition, the gas line 26 and block 22 always align for maximum efficiency and longevity. In addition, the handguard 28A and upper assembly 32A can be of different shapes since the handguard 28A can slide over or otherwise be positioned about the muzzle brake 20. Finally, the sight attached to the handguard 28A can remain true with respect to barrel orientation.

Figures 7A, 7B, 7C:
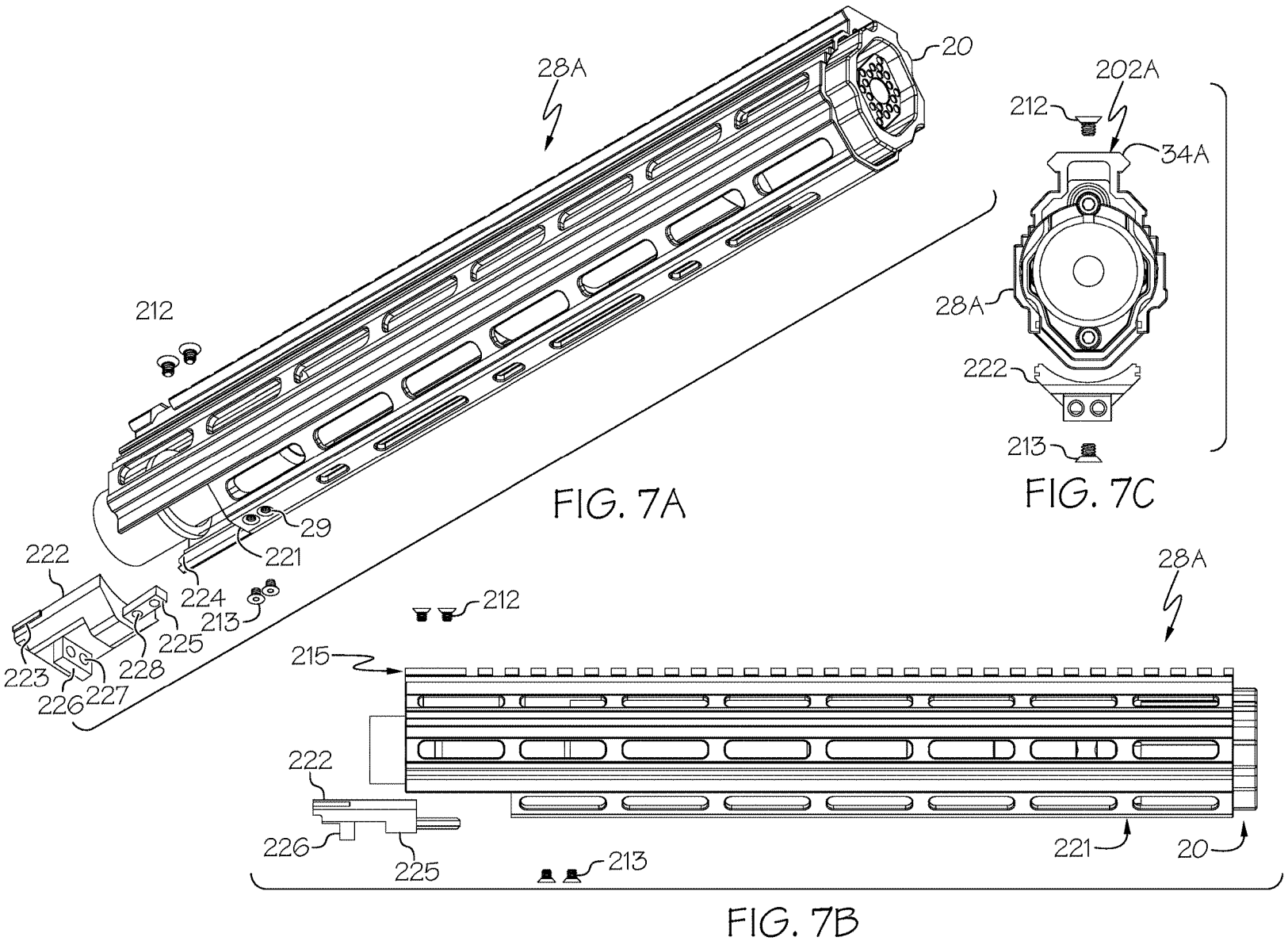
FIG. 7A is a perspective view of a handguard of a firearm, in accordance with some embodiments.
FIG. 7B is a side view of the handguard of FIG. 7A.
FIG. 7C is a front view of the handguard of FIGS. 7A and 7B.

FIG. 7A is a perspective view of a handguard 28A of the firearm, in accordance with some embodiments. FIG. 7B is a side view of the handguard 28A of FIG. 7A. FIG. 7C is a front view of the handguard 28A of FIGS. 7A and 7B.

The handguard 28A is constructed and arranged to slide over a muzzle brake assembly 20. In some embodiments, the muzzle brake assembly 20 and interior surface of the handguard 28A are non-circular, or asymmetrical so that the handguard 28A cannot be turned, rotated, or otherwise articulated during operation.

The handguard 28A is further prevented from rotating when coupled to the upper assembly 32A by a lower mounting system comprising a first element 221 extending from a bottom region of the handguard 28A and a second element 222 that is configured to couple to the first element 221 by one or more mounting bolts 213. The second element 222 includes one or more alignment bosses 223, preferably two alignment bosses 223 that correlate to grooves 224, slots, or the like in the first element 221. The groove 224 can capture the second element 222 without fasteners or related coupling devices.

Figure 8A:
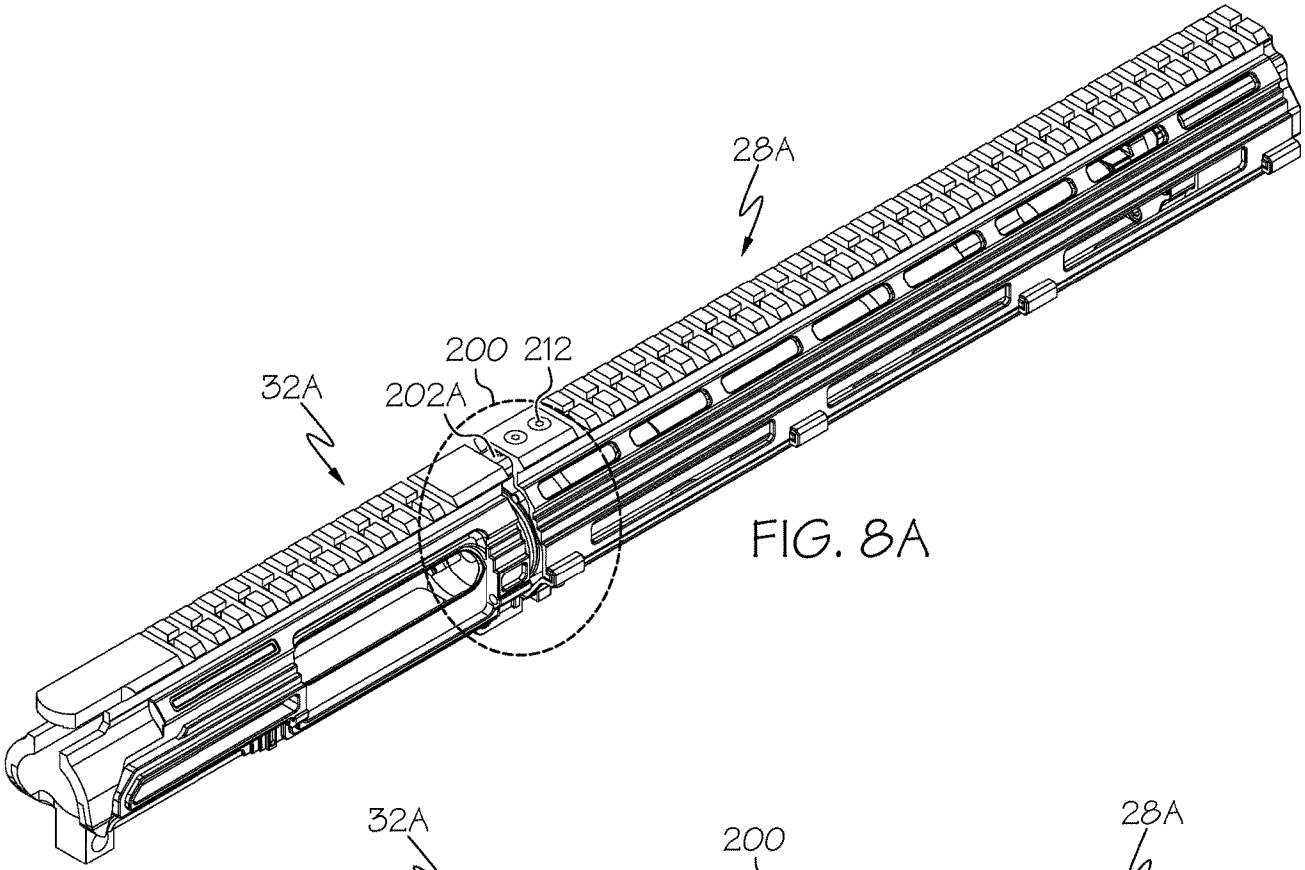
FIG. 8A is a perspective view of an assembly including the upper assembly of FIGS. 6A-6C and the handguard of FIGS. 7A-7C coupled together in accordance with some embodiments.
Figure 8B:
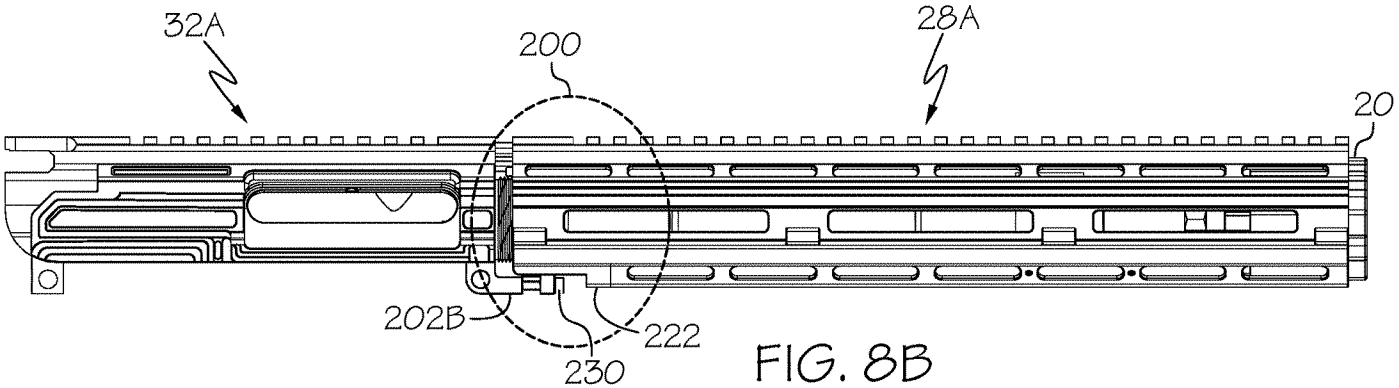
FIG. 8B is a side view of the assembly of FIG. 8A.

As shown in FIGS. 8A and 8B, a firearm coupling mechanism 200 comprises an upper mounting system for directly coupling the handguard 28A to the upper assembly 32A, and for preventing undesirable rotation of the handguard 28A or upper assembly 32A. The upper mounting system may include the top tabs 202A extending from the upper assembly 32A and the first element 221 and second element 222 extending from the handguard 28A. In some embodiments, the top tab 202A of the upper assembly 32A is inserted into an aperture, groove, hole, or the like in the handguard rail end 215, of the handguard 28A. The handguard rail end 215 may be similar to or the same as the rail end 30 described in FIGS. 2-5, except that handguard rail end 215 includes at least one hole extending through a top surface that provides a communication path with the aperture, groove, or the like through which the top tab 202A slides or is otherwise inserted so that the holes 203 of the top tab 202A can be aligned with the top surface holes for receiving mounting bolts 212 or related coupling elements, and permits a secure coupling or mating of the handguard 28A and upper assembly 32A at the top regions of the handguard 28A and upper assembly 32A.

The bottom tab 202B of the upper assembly 32A is configured to couple to the second element 222, which in turn is coupled to the handguard 28A. In particular, the second element 222 includes an extension 225, which includes at least one hole 228, and preferably two holes 228, which can align with holes 29 in the bottom region of the handguard 28A for receiving bottom mounting bolts 213. In addition, the alignment bosses 223 permits a secure coupling or mating of the handguard 28A and second element at the bottom regions of the handguard 28A and upper assembly 32A. The alignment bosses can correlate to grooves 224 or the like in the handguard 228, which can permit the second element 222 to be captured by the grooves 224 without additional fasteners.

The second element 222 also includes a bottom portion 226 that extends perpendicular or tangential direction relative to the length of the second element 222 and extension 225. The bottom portion includes at least one hole 227, and preferably two holes 227, which can align with the mounting holes 203 in the bottom tab 202B of the upper assembly 32B, so that both the mounting holes 203 and the bottom portion holes 227 can receive coupling bolts 230. Coupling bolts 230 can have a different size, shape, configuration, thread arrangement, and so on that the mounting bolts 213. The firearm coupling mechanism 200 therefore prevents the handguard 28A from turning, rotating or the like when elements 202A and 202B are bolted to the top and bottom regions of the firearm. The asymmetric shape of the handguard over the muzzle brake assembly 20 can also contribute to preventing undesirable movement of the handguard 28A.

Figure 9A:
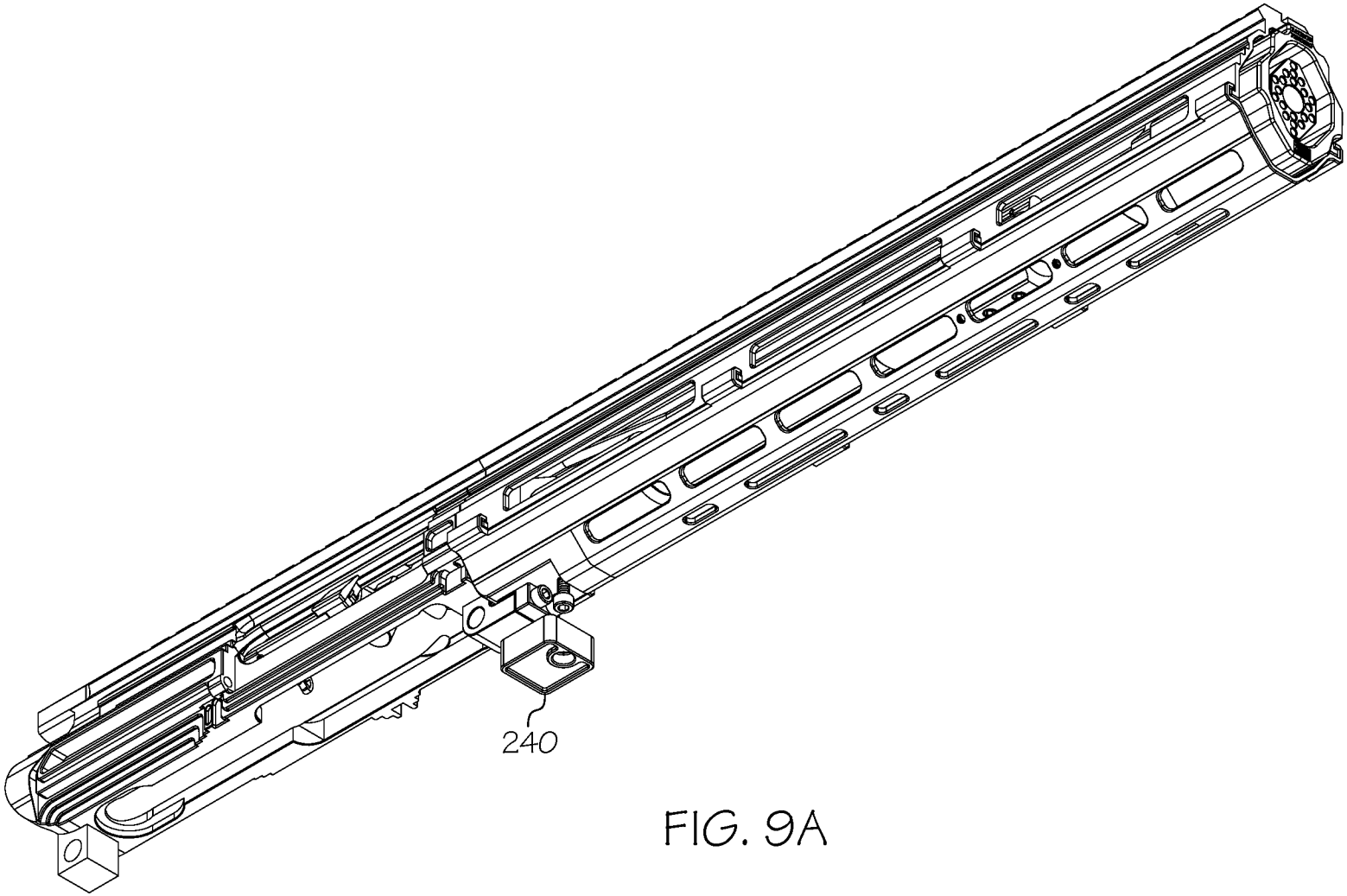
FIG. 9A is a perspective view of a locking system for the assembly of FIGS. 6A-8B, in accordance with some embodiments.
Figure 9B:
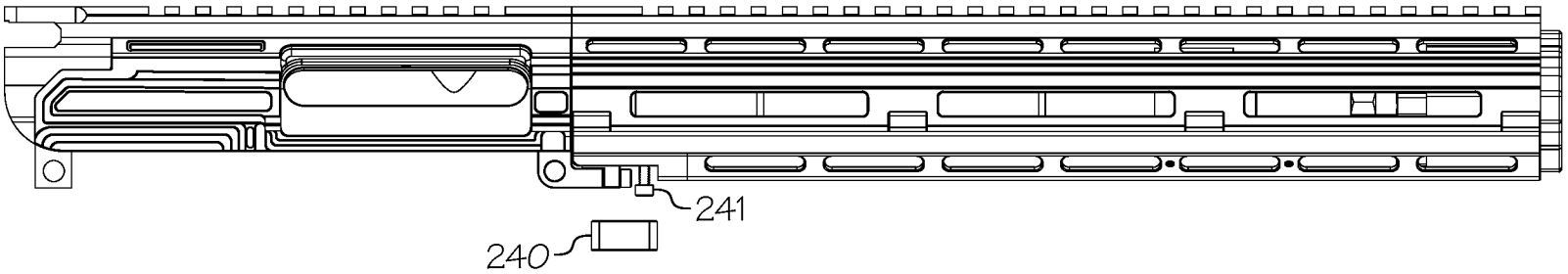
FIG. 9B is a side view of the locking system and assembly of FIG. 9A.
Figure 9C:
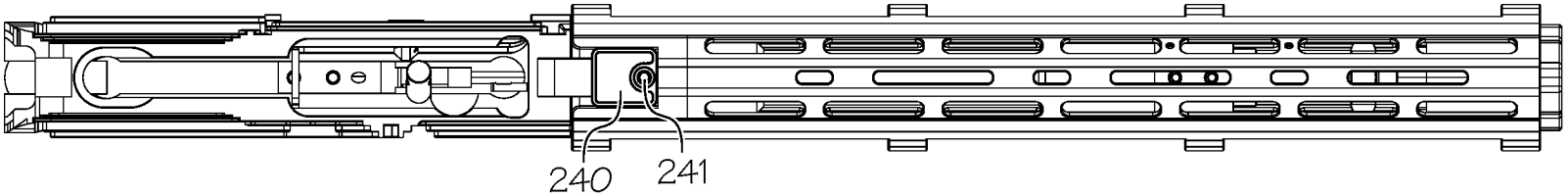
FIG. 9C is a bottom view of the locking system and assembly of FIGS. 9A and 9B.

As shown in FIGS. 9A-9C, a cap 240 can cover the lower fasteners, in particular, the bottom tab 202B of the upper assembly 32B, the coupling bolt(s) 230, and bottom portion 226 of the second element 222. A bolt 241 or other coupling element can be inserted through a hole in the cap 240 and a hole in the handguard 28A, for example, a threaded hole. The cap 240 has a surface constructed and arranged for positioning behind the bolt heads. The cap 240 covers the sides of the region of intersection at the lower region of the assembly comprising the handguard 28A and upper assembly 32A. The cap 240 has a wall that abuts the bolts preventing bolts from rotating and possibly loosening. In some embodiments, the cap 240 extends laterally past a length of the assembly comprising the handguard 28A and upper assembly 32A, which reduces stress on the fasteners or coupling elements, while also preventing or reducing rotation between the handguard 28A and upper assembly 32A.

Although the present invention has been disclosed in the form of preferred embodiments and variations thereon, it will be understood that numerous additional modifications and variations could be made thereto without departing from the scope of the invention.

For the sake of clarity, it is to be understood that the use of "a" or "an" throughout this application does not exclude a plurality, and "comprising" does not exclude other steps or elements. The mention of a "unit" or a "module" does not preclude the use of more than one unit or module.

What is claimed is:

1. A coupling system for a firearm, comprising:

an upper mounting system constructed and arranged for directly coupling an upper assembly to a handguard of a firearm, the upper mounting system extending in a linear direction from the upper assembly to the handguard;

a lower mounting system constructed and arranged for directly coupling the handguard to the upper assembly, the lower mounting extending in the linear direction from the upper assembly to the handguard; and a plurality of first coupling elements that extend vertically through the upper mounting system and a plurality of second coupling elements that extend horizontally through the lower mounting system to couple the handguard to the upper assembly and for applying a force that maintains an interface between the handguard and the upper assembly, wherein the lower mounting system comprises a bottom tab extending from the upper assembly, a first element extending from a bottom region of the handguard, and a second element having an extension configured for insertion into the first element in the linear direction and a bottom portion extending perpendicular to the linear direction and configured for providing an interface between the bottom tab and the plurality of second coupling elements.

2. The coupling system of claim 1, wherein the upper mounting system comprises a top tab extending from the upper assembly and a slot in the handguard for receiving the top tab.

3. The coupling system of claim 2, where the top tab includes one or more holes constructed and arranged for alignment with one or more holes of the handguard, and where in the upper mounting system includes one or more fastening devices that extend through the holes of the top tab and terminate at holes of the handguard.

4. The coupling mechanism of claim 2, wherein the top tab extends from a tapered end of the upper assembly and the bottom tab extends from a bottom region of the upper assembly.

5. The coupling mechanism of claim 4, wherein the top tab is unitary with and is formed of a same common stock as the upper assembly.

6. The coupling mechanism of claim 2, wherein the top tab includes at least one hole that provides a communication path with a hole in a rail end of the handguard for receiving a first coupling element of the plurality of first coupling elements.

7. The coupling mechanism of claim 2, wherein the bottom tab couples the plurality of second coupling elements which extending in the linear direction, and wherein the plurality of second coupling elements in turn couple to the handguard.

8. The coupling mechanism of claim 1, wherein the second element further comprises at least one alignment boss that couples with a bottom region of the handguard to prevent further rotation of the handguard relative to the upper assembly.

9. The coupling mechanism of claim 8, wherein the body engaging portion has a coupling feature for engaging with a tapered sidewall of the handguard r end.

* * * * *